US012091277B2

(12) United States Patent
Nakatomi et al.

(10) Patent No.: US 12,091,277 B2
(45) Date of Patent: Sep. 17, 2024

(54) SHEET CONVEYANCE DEVICE AND IMAGE FORMING APPARATUS

(71) Applicant: CANON KABUSHIKI KAISHA, Tokyo (JP)

(72) Inventors: Yuta Nakatomi, Shizuoka (JP); Motoyasu Muramatsu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 192 days.

(21) Appl. No.: 17/707,376

(22) Filed: Mar. 29, 2022

(65) Prior Publication Data

US 2022/0315362 A1 Oct. 6, 2022

(30) Foreign Application Priority Data

Mar. 31, 2021 (JP) ..... 2021-060819

(51) Int. Cl.
*B65H 5/06* (2006.01)

(52) U.S. Cl.
CPC ..... *B65H 5/06* (2013.01); *B65H 2402/52* (2013.01); *B65H 2404/17* (2013.01); *B65H 2801/06* (2013.01)

(58) Field of Classification Search
CPC ..... B65H 5/062; B65H 5/06; B65H 5/068; B65H 2404/17; B65H 2402/52; B65H 2601/324; G03G 2221/1654; G03G 21/1821; G03G 21/1695; G03G 21/1647
See application file for complete search history.

(56) References Cited

FOREIGN PATENT DOCUMENTS

| | | | |
|---|---|---|---|
| JP | 11236919 A | * | 8/1999 |
| JP | 2012047285 A | * | 3/2012 |
| JP | 4988245 B2 | | 8/2012 |

* cited by examiner

*Primary Examiner* — Luis A Gonzalez
(74) *Attorney, Agent, or Firm* — Canon U.S.A., Inc. IP Division

(57) ABSTRACT

A sheet conveyance device includes a conveyance roller having first and second end portions in a rotation axis direction, an open bearing supporting the first end portion, a frame supporting the open bearing, and a second end support portion supporting the second end portion. The open bearing includes a roller support portion supporting the conveyance roller and an open portion allowing the conveyance roller to be removed through the open portion from the roller support portion in a direction perpendicular to a rotation axis. The open bearing is movable from a first position, at which the conveyance roller is restricted from moving, to a second position at which the conveyance roller can move in the rotation axis direction. The second end portion is removable from the second end support portion by moving the conveyance roller from the second toward first end portion with the open bearing at the second position.

8 Claims, 15 Drawing Sheets

SHEET CONVEYANCE DEVICE AND IMAGE FORMING APPARATUS

BACKGROUND

Field

The present disclosure relates to a sheet conveyance device for conveying a sheet and an image forming apparatus using the sheet conveyance device.

Description of the Related Art

In existing image forming apparatuses, such as printers, copying machines, and facsimiles, a sheet is conveyed by a conveyance roller provided in the sheet conveyance device.

In recent years, with increasing lifetime of image forming apparatuses, improvement of the maintainability of internal parts has been required. In particular, the conveyance roller is gradually abraded away when nipping and conveying sheets. As a result, the conveyance roller needs to be replaced periodically.

Japanese Patent No. 4988245 describes a configuration that makes a rotating shaft and a roller member including a bearing member fixed to the rotating shaft replaceable.

However, according to the configuration described in Japanese Patent No. 4988245, when the roller member is replaced, the bearing member also needs to be replaced.

SUMMARY

According to an aspect of the present disclosure, a sheet conveyance device includes a conveyance roller configured to rotate about an axis of rotation to convey a sheet, wherein the conveyance roller has a first end portion and a second end portion in a direction of the axis of rotation, an open bearing configured to support the first end portion so that the conveyance roller is rotatable, a frame configured to support the open bearing, and a second end support portion configured to support the second end portion so that the conveyance roller is rotatable, wherein the open bearing includes a conveyance roller support portion configured to support the conveyance roller and an open portion configured to allow the conveyance roller to be removed through the open portion from the conveyance roller support portion in a direction perpendicular to the axis of rotation, wherein, when the open bearing is mounted in the frame, the open bearing is movable between a first position at which the conveyance roller is restricted from moving in the direction of the axis of rotation and a second position at which the conveyance roller is configured to move in the direction of the axis of rotation, wherein the open bearing is movable from the first position to the second position so that the conveyance roller passes through the open portion, and wherein the second end portion is removable from the second end support portion by moving the conveyance roller from the second end portion toward the first end portion with the open bearing located at the second position.

Further features of the present disclosure will become apparent from the following description of exemplary embodiments with reference to the attached drawings.

DESCRIPTION OF THE EMBODIMENTS

First Embodiment

As an example of the configuration of an image forming apparatus including a sheet conveyance device according to the present disclosure, an embodiment in which the configuration is applied to an electrophotographic laser printer is described in detail below. In the description, the overall configuration of the image forming apparatus according to the present disclosure is described first and, thereafter, the configuration of a sheet conveyance device of the image forming apparatus according to the present disclosure is described.

It should be noted that the dimensions, materials, shapes, relative locations, and the like of the constituent elements described in the present embodiment are not intended to limit the scope of the present disclosure unless otherwise specified. In addition, the image forming apparatus according to the present disclosure is not limited to a laser printer, and may be applied to other image forming apparatuses, such as a copying machine and a facsimile.

Image Forming Apparatus

Figure 1:
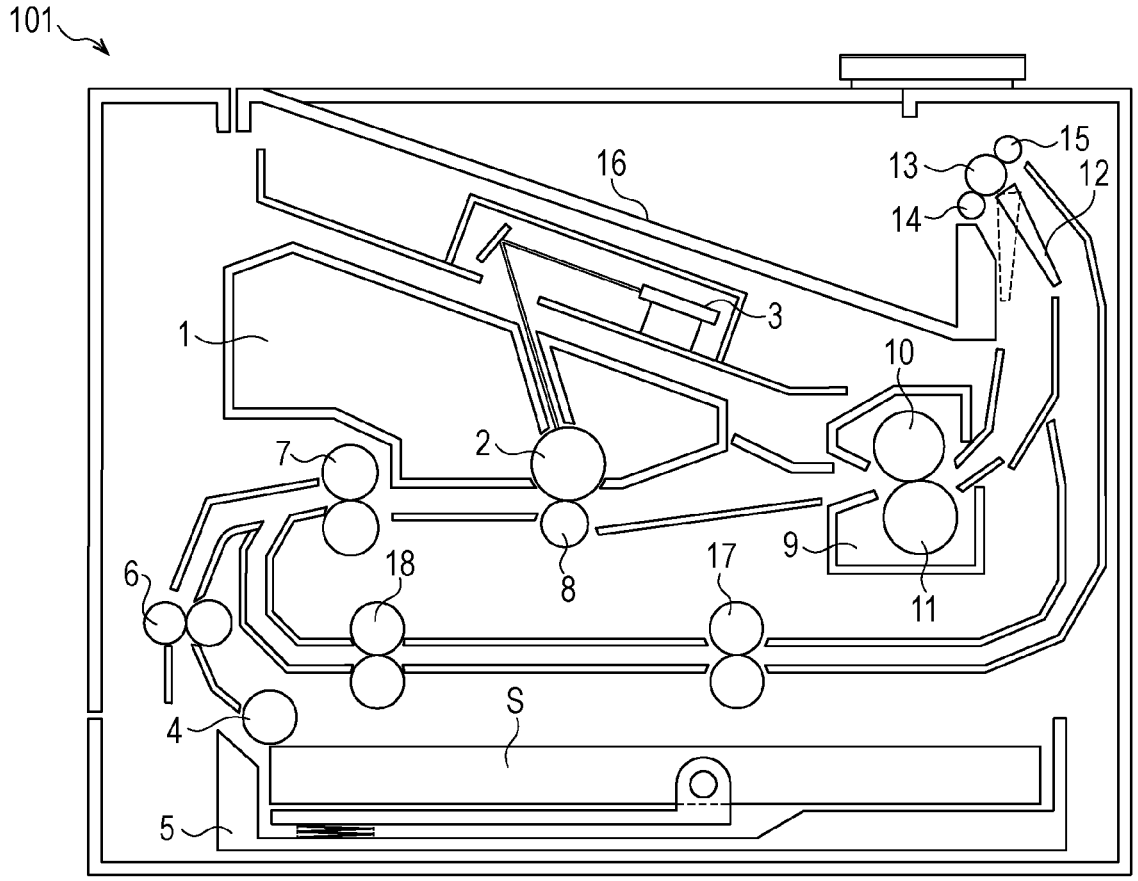
FIG. 1 is a schematic illustration of an image forming apparatus according to a first embodiment.

FIG. 1 is a cross-sectional view illustrating the configuration of an electrophotographic laser printer having a double-sided image forming function as an example of the image forming apparatus according to the present embodiment.

An image forming apparatus 101 illustrated in FIG. 1 is broadly divided into a sheet feeding unit, an image forming unit that forms an image on a sheet, a fixing unit, an output sheet turnover unit, and a double-sided conveyance unit.

The image forming apparatus 101 includes a process cartridge 1 removable from an apparatus main body. The process cartridge 1 includes process units, such as a photosensitive drum 2, a developing unit (not illustrated), and a charging roller.

A scanner unit 3 is disposed vertically above the process cartridge 1 and exposes the photosensitive drum 2 on the basis of an image signal. After the photosensitive drum 2 is charged to a predetermined negative polarity potential by a charging roller (not illustrated), an electrostatic latent image is formed by the scanner unit 3. The electrostatic latent image is reverse developed by a developing unit (not illustrated) in the process cartridge 1, and toner of negative polarity is deposited. Thus, a toner image is formed.

The sheet feeding unit includes a sheet feeding roller 4 mounted in the image forming apparatus 101 and a sheet feeding cassette 5 that stores sheets S, such as paper sheets. The sheet feeding cassette 5 is removable from the main body of the image forming apparatus 101. The sheets S stored in the sheet feeding cassette 5 are separated and fed one by one from the sheet feeding cassette 5 by the sheet feeding roller 4 rotated by the power from a feed drive unit (not illustrated). The fed sheet S is conveyed to a registration roller pair 7 by a paper feed and convey roller pair 6. Thereafter, the sheet S is subjected to skew correction by the registration roller pair 7 and is conveyed to a transfer unit.

The transfer unit is configured to apply a positive bias to a transfer roller 8 by using a bias applying unit (not illustrated). As a result, the toner image is transferred, as an unfixed image, to the sheet S conveyed to the transfer unit.

The sheet S having the toner image transferred thereon is conveyed to a fixing device 9 disposed downstream of the transfer unit in the conveyance direction. The fixing device 9 fixes the toner image transferred onto the sheet S. The fixing device 9 includes a heating roller 10, which is a fixing member, and a pressure roller 11, which is a pressure member.

The heating roller 10 is heated by a heater, which is a heating unit (not illustrated). The pressure roller 11 is in presses contact with the heating roller 10 and rotates. The sheet S is nipped and conveyed in a fixing nip portion formed by the heating roller 10 and the pressure roller 11. Due to heat and pressure applied to the sheet S, the toner image is fixed onto a surface of the sheet S.

The sheet S having the toner image fixed thereto is conveyed from the fixing device 9 to the output sheet turnover unit. The output sheet turnover unit includes a discharge roller 13, a discharge driven roller 14, a turnover driven roller 15, and a double-sided flapper 12. In the case of single-sided printing in which an image is formed on only one side of the sheet S, the double-sided flapper 12 stands by at the position shown as a solid line so as to lead the sheet S to a discharge nip portion formed by the discharge roller 13 and the discharge driven roller 14. Then, the sheet S is discharged onto a sheet discharge tray 16 by the discharge roller 13 and the discharge driven roller 14.

In contrast, in the case of double-sided printing in which an image is formed on both sides of the sheet S, the double-sided flapper 12 stands by at the position shown as a dotted line so as to lead the sheet S to a reversing nip portion formed by the discharge roller 13 and the turnover driven roller 15. Then, the sheet S is conveyed to the reversing nip portion by the fixing device 9. The discharge roller 13 rotates in the opposite direction by a rotation direction switching unit (not illustrated) at the time when the trailing edge of the sheet S reaches a predetermined position. As a result, the sheet S passes through a conveyance roller pair 17 and a re-feed roller pair 18 with the trailing and leading edges reversed, and the sheet S that is turned over is conveyed again to the registration roller pair 7.

Subsequently, as in single-sided printing, the sheet S is skew-corrected by the registration roller pair 7. A toner image is transferred to the second surface of the sheet S by the transfer roller 8, and the toner image is fixed by the fixing device 9. Thereafter, the sheet S is discharged to the sheet discharge tray 16 by the discharge roller 13 and the discharge driven roller 14. Thus, double-sided printing is completed.

Sheet Conveyance Device

The section of the image forming apparatus 101 related to conveyance of the sheet S can be referred to as a sheet conveyance device 100. The sheet conveyance device 100 according to the present disclosure is described below with reference to FIGS. 2 to 10C.

Figure 2:
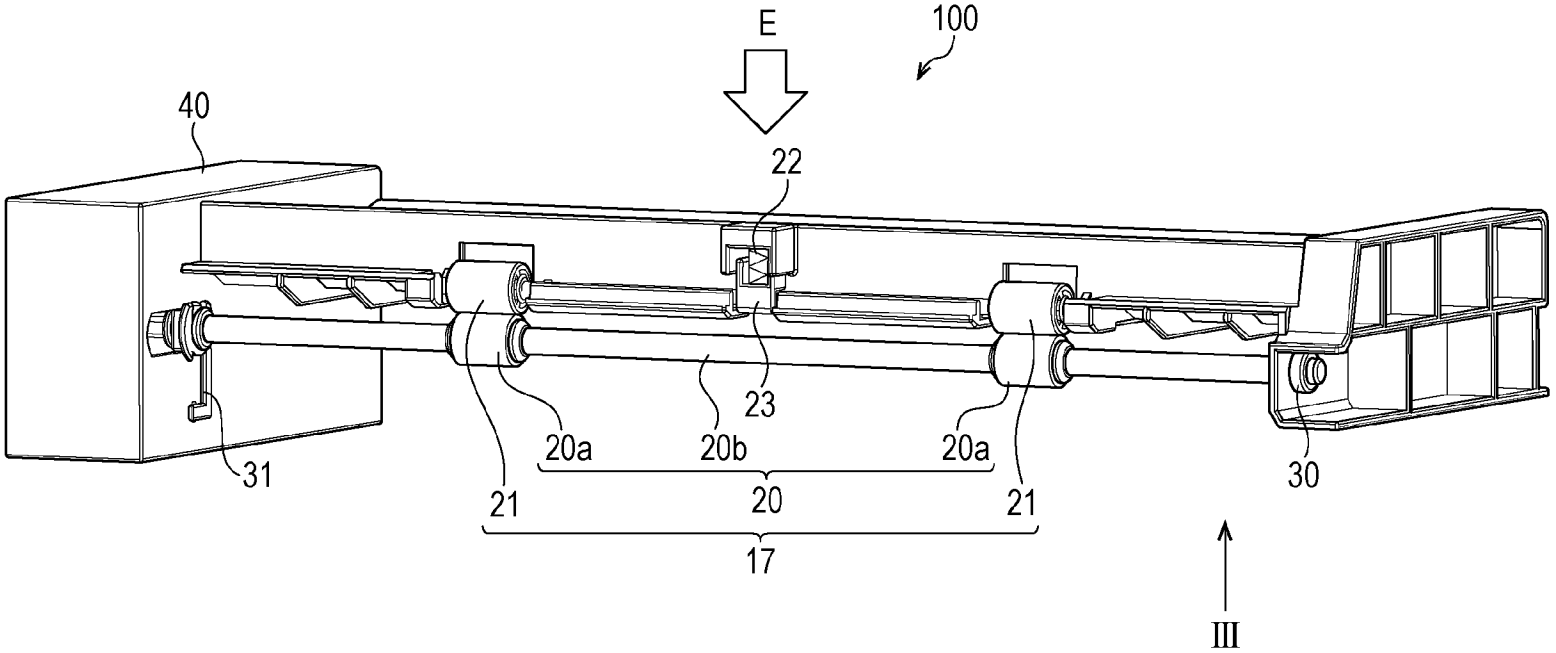
FIG. 2 is a perspective view illustrating the location of a sheet conveyance device according to the first embodiment.
Figure 3:
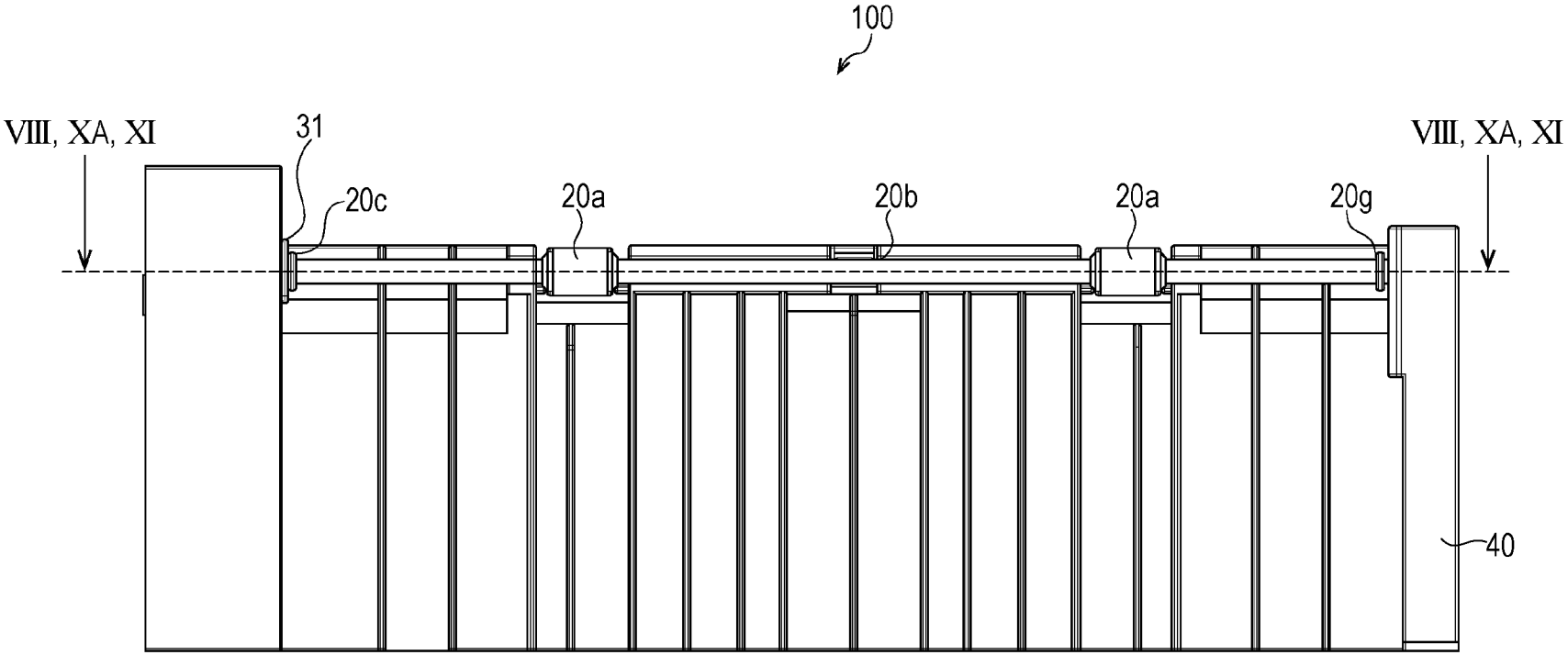
FIG. 3 is a bottom view illustrating the location of the sheet conveyance device viewed in the vertical direction according to the first embodiment.
Figure 4:
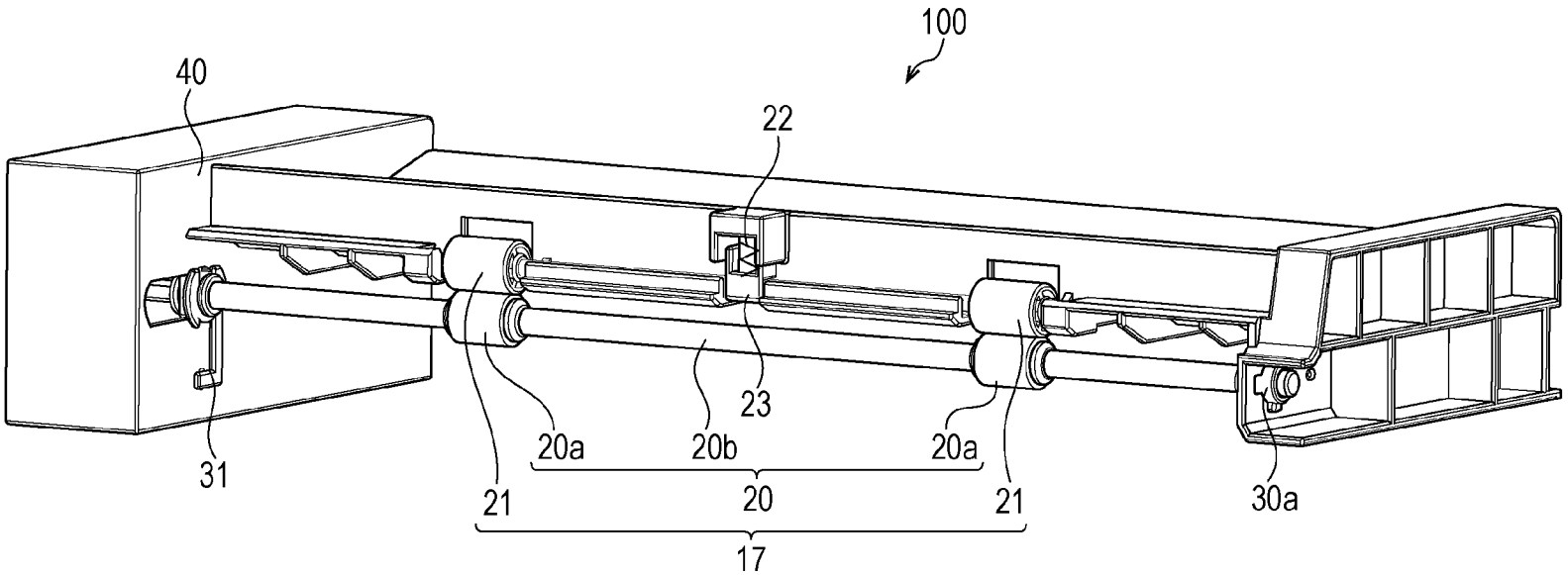
FIG. 4 is a perspective view illustrating the location of the sheet conveyance device when a bearing portion according to the first embodiment is composed of a bearing member that differs from a frame.

FIGS. 2 and 3 illustrate the sheet conveyance device 100 including a frame 40 having, assembled thereto, a conveyance roller 20 and a driven roller 21 that constitute the conveyance roller pair 17. FIG. 2 is a perspective view illustrating the location of the sheet conveyance device 100 according to the first embodiment. FIG. 3 is a bottom view illustrating the location of the sheet conveyance device 100 according to the first embodiment, as viewed in the vertical direction. FIG. 3 is a view of the sheet conveyance device 100 viewed from below in the vertical direction (the direction of an arrow III illustrated in FIG. 2). FIG. 4 is a perspective view illustrating the location of the sheet conveyance device 100 when a bearing portion 30 according to the first embodiment is composed of a bearing member 30*a*, which differs from the frame 40.

The sheet conveyance device 100 includes the conveyance roller pair 17 including the conveyance roller 20, the frame 40, an open bearing 31, and the bearing portion 30.

As illustrated in FIGS. 2 and 3, the conveyance roller 20 rotates about an axis of rotation. The conveyance roller 20 includes a roller member 20*a* and a shaft member 20*b* and has a first end portion and a second end portion in the direction of the axis of rotation. The driven roller 21 nips and conveys the sheet S together with the conveyance roller 20. The driven roller 21 is urged in an E direction toward the conveyance roller 20 via a spring bearing member 23 by an urging member 22 which is a compression spring. The conveyance roller 20 is urged in the E direction via the driven roller 21.

A first end portion of the shaft member 20*b* (the first end portion of the conveyance roller 20) is supported by the open bearing 31 so that the conveyance roller 20 can rotate, and a second end portion of the shaft member 20*b* (the second end portion of the conveyance roller 20) is supported by a bearing portion 30 serving as a second end support portion.

According to the present embodiment, the number of constituent elements is reduced by providing the bearing portion 30 in the frame 40. More specifically, the frame 40 is a metal plate, and the bearing portion 30 is formed as an integral part of the frame 40. However, as illustrated in FIG. 4, the bearing portion 30 may be configured to use a member that differs from the frame 40, such as a bearing member 30*a* that supports the entire circumference of an end portion of the shaft member 20*b* or the open bearing 31 (described below). At this time, by using a highly slidable material as the different member that constitutes the bearing portion, the slidability of the conveyance roller 20 can be increased.

Figure 5A:
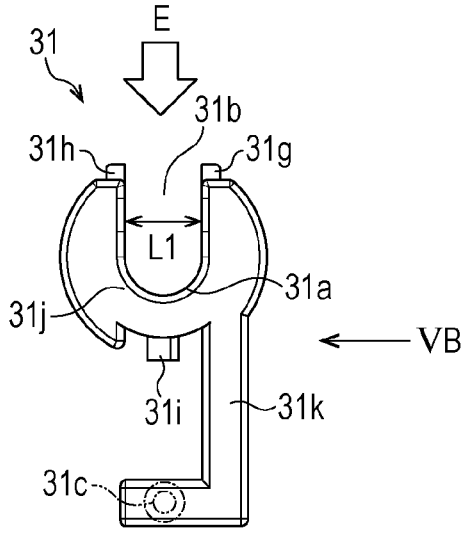
FIGS. 5A to 5C are configuration diagrams illustrating the configuration of an open bearing according to the first embodiment.
Figure 5B:
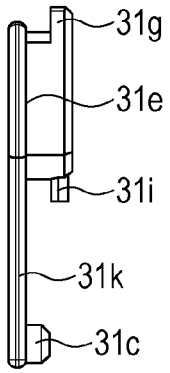
Figure 5C:
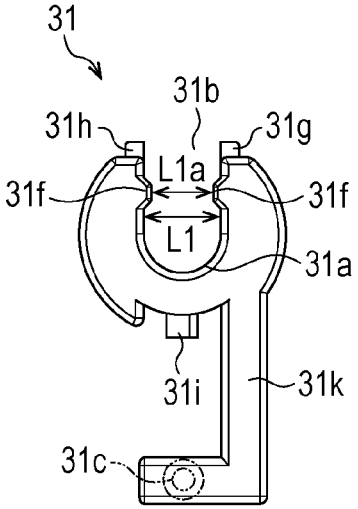

Subsequently, a method for engaging the open bearing 31 with the frame 40 is described with reference to FIGS. 5A to 8. FIG. 8 is an enlarged view of an engaging portion between the open bearing 31 and the shaft member 20*b* and an engaging portion between the bearing portion 30 and the shaft member 20*b* in the cross-sectional view taken along the line VIII-VIII in FIG. 3. FIGS. 5A to 5C illustrate the configuration of the open bearing 31 that supports the conveyance roller 20. FIG. 5A is a view of the open bearing 31 viewed in the rotation axis direction from the midpoint of a sheet in the width direction, and FIG. 5B is a view of the open bearing 31 viewed in a VB direction illustrated in FIG. 5A. In addition, an arrow E illustrated in FIG. 5A indicates the urging direction of the urging force given to the conveyance roller 20 by the driven roller 21.

The open bearing 31 includes a semicircular conveyance roller support portion 31*a* that supports the conveyance roller 20 that receives the urging force in the E direction and an open portion 31*b* that opens on the opposite direction side to the urging force received by the conveyance roller 20 in the E direction. The first end portion of the conveyance roller 20 can be removed from the conveyance roller support portion 31*a* in a direction perpendicular to the axis of rotation of the conveyance roller 20 by passing through the open portion 31*b*. The open bearing 31 further includes a rotation stopped portion 31*c* with respect to the frame 40 and a regulation portion 31*j* that regulates the movement of the conveyance roller 20 in the rotation axis direction at the first position (described below).

Figure 6:
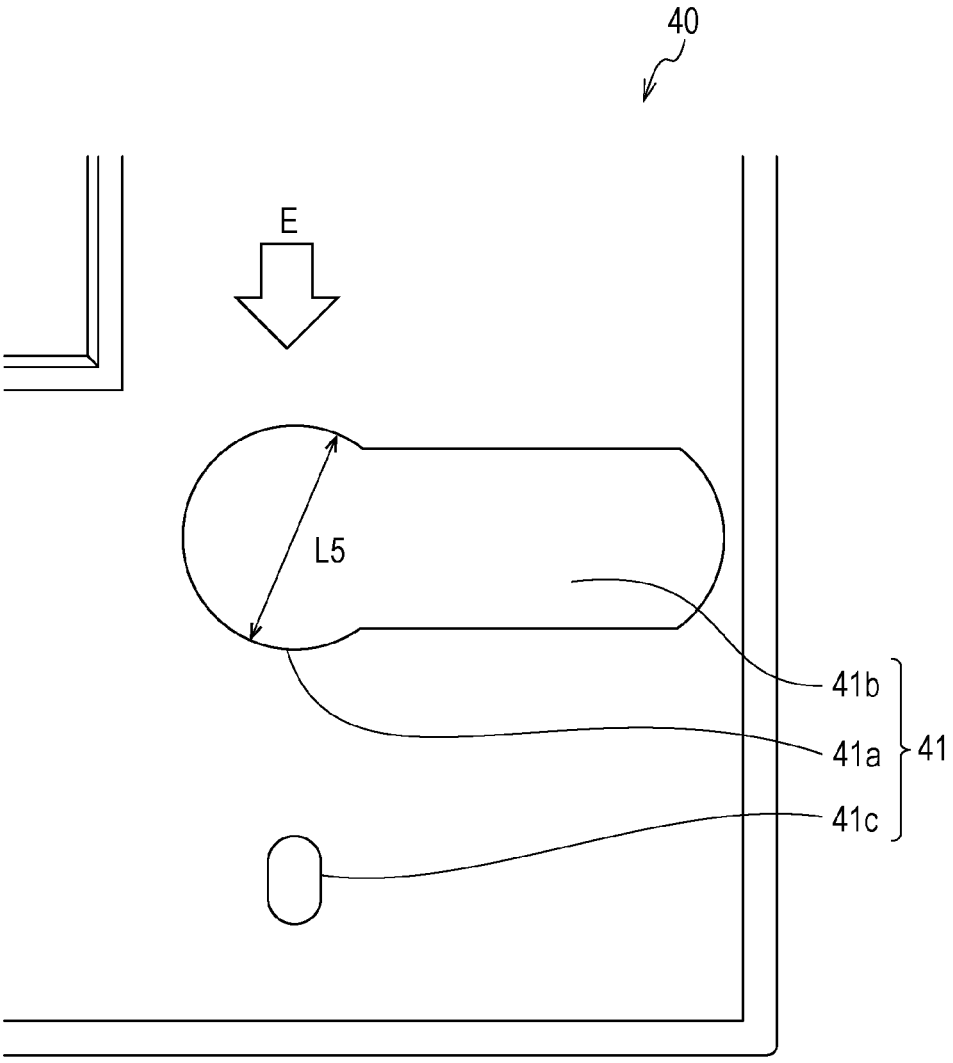
FIG. 6 illustrates the configuration of a bearing receiving portion of the frame according to the first embodiment.

FIG. 6 is a view of a bearing receiving portion 41 of the frame 40 that supports the open bearing 31, as viewed in an H direction in FIG. 8, which is the direction from the open bearing 31 to the bearing portion 30.

The bearing receiving portion 41 illustrated in FIG. 6 has a bearing support portion (a first portion) 41*a* that supports the open bearing 31 so that the open bearing 31 is located at a first position (described below). In addition, the bearing receiving portion 41 has a frame notch portion 41*b* (a guide portion, a second portion) that leads the open bearing 31 from the first position to a second position (described below) and a rotation stopper portion 41*c* that engages with the rotation stopped portion 31*c* of the open bearing 31. The bearing support portion 41*a* and the frame notch portion 41*b* are a hole (a first hole) formed in the frame 40. The rotation stopper portion 41*c* is a hole (a second hole) formed in the frame 40. The bearing support portion 41*a* and the frame notch portion 41*b* are connected to each other. The rotation stopper portion 41*c* is disposed at position separated from each of the bearing support portion 41*a* and the frame notch portion 41*b*.

Figure 7A:
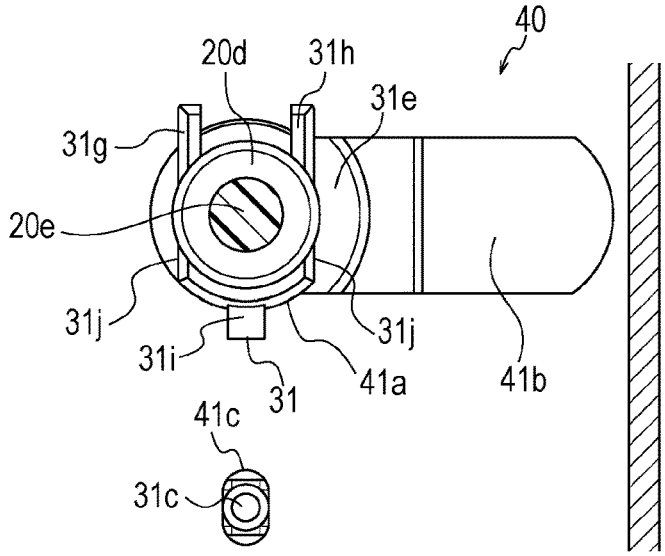
FIGS. 7A to 7C illustrate a relationship between the bearing receiving portion of the frame and the open bearing according to the first embodiment.
Figure 7B:
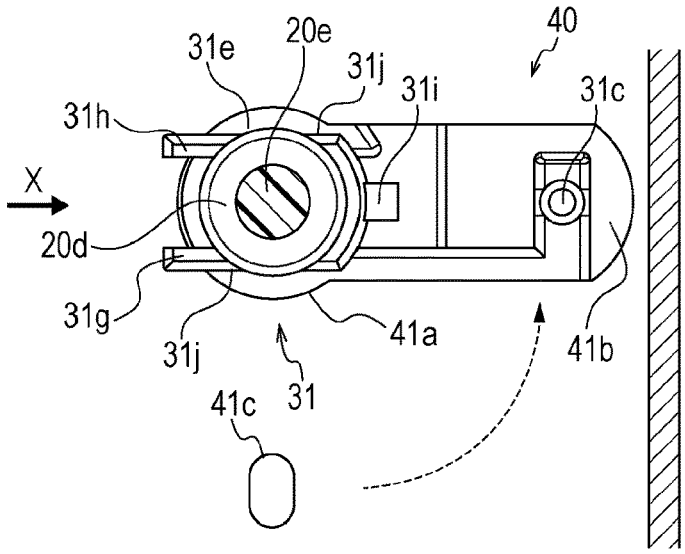
Figure 7C:
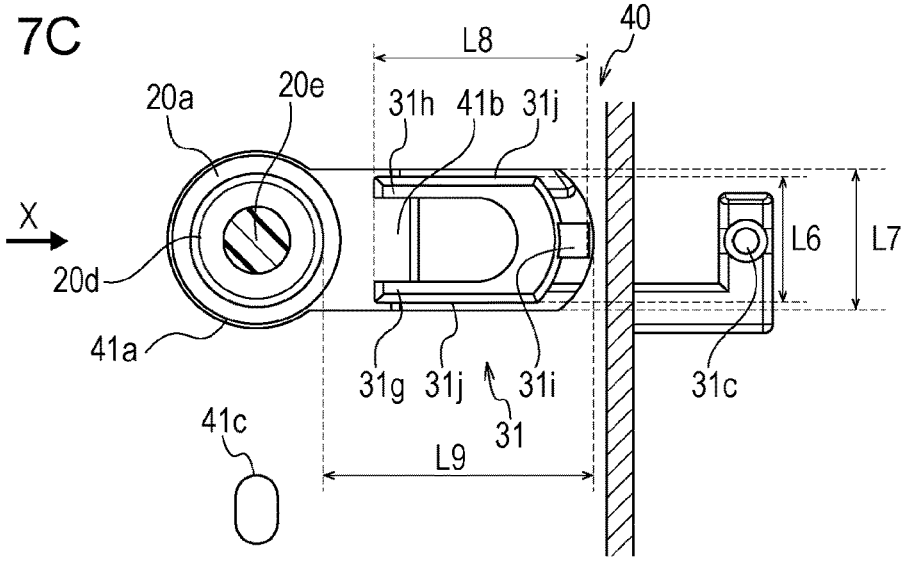
Figure 8:
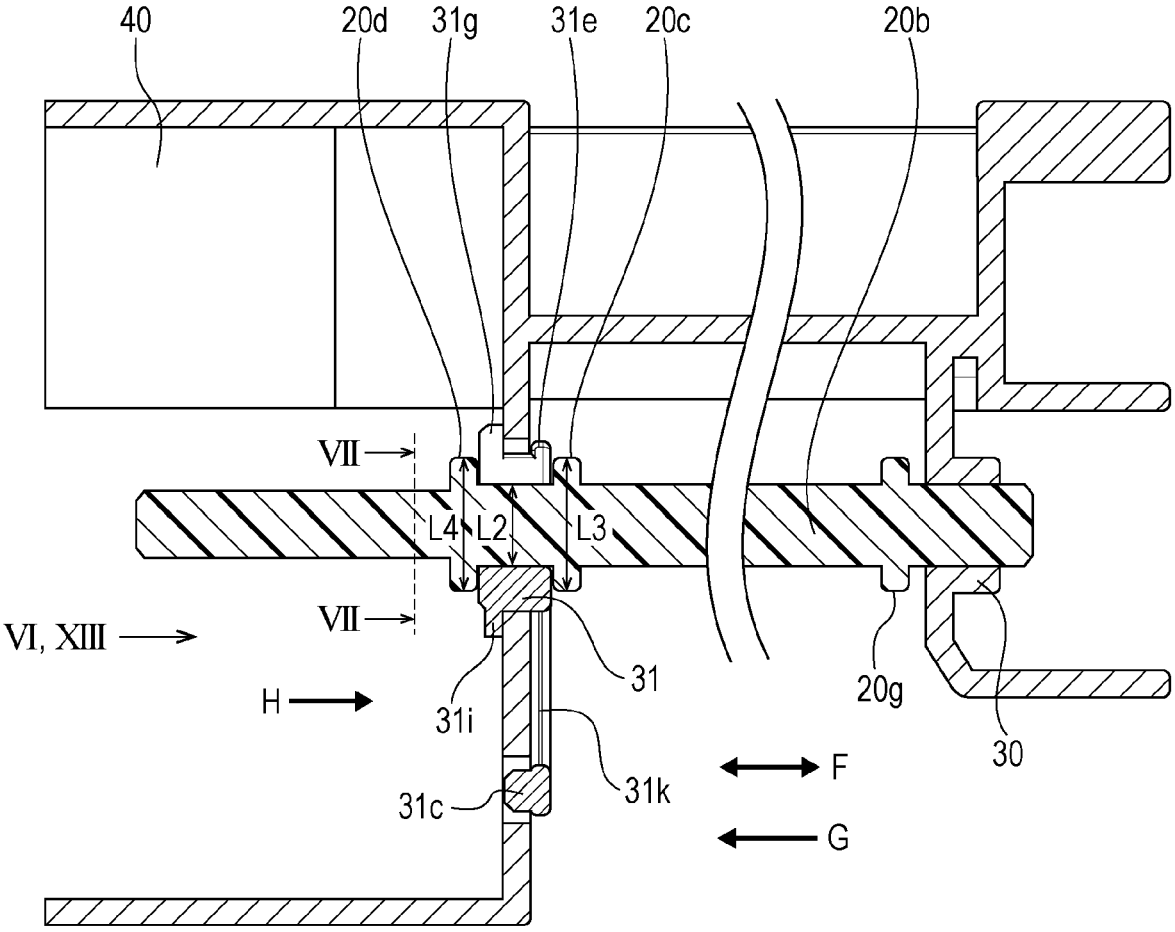
FIG. 8 is a cross-sectional view of an engaging portion between the open bearing and a shaft member and an engaging portion between the bearing portion and the shaft member according to the first embodiment.

FIGS. 7A to 7C illustrate three modes of the open bearing 31 with respect to the bearing receiving portion 41, and FIGS. 7A to 7C are cross-sectional views taken along a line WI-WI in FIG. 8. FIG. 7A illustrates the open bearing 31 located at the first position. FIG. 7B illustrates the open bearing 31 located at a third position. FIG. 7C illustrates the open bearing 31 located at the second position.

As illustrated in FIG. 7A, when the open bearing 31 is located at the first position, the open bearing 31 supports the conveyance roller 20 so that the conveyance roller 20 can rotate, and the movement of the conveyance roller 20 in the direction of the axis of rotation is restricted. When the open bearing 31 located at the first position, the rotation stopped portion 31*c* of the open bearing 31 is engaged with the rotation stopper portion 41*c* of the frame 40 in order to restrict the rotation of the open bearing 31. Furthermore, the open bearing 31 is restricted from moving from the first position to the second position.

By disengaging the rotation stopped portion 31*c* from the rotation stopper portion 41*c*, the open bearing 31 is enabled to move from the first position to the third position. According to the present embodiment, the open bearing 31 rotates counterclockwise in FIG. 7B and moves from the first position to the third position. As illustrated in FIG. 7B, when the open bearing 31 is located at the third position, the engagement between the rotation stopped portion 31*c* and the rotation stopper portion 41*c* is disengaged, and the open bearing 31 is enabled to move to the second position.

As illustrated in FIG. 7C, when the open bearing 31 is located at the second position, the open bearing 31 is removed from the conveyance roller 20, and the conveyance roller 20 is enabled to move in the rotation axis direction. According to the present embodiment, the second position is the position to which the open bearing 31 is moved from the third position (FIG. 7B) in the X direction, which is the direction in which the frame notch portion 41*b* is located.

The open bearing 31 includes an arm 31*k* serving as an operating unit. The arm 31*k* extends in a direction intersecting (preferably perpendicular to) the direction of the axis of rotation of the conveyance roller 20. The arm 31*k* has the rotation stopped portion 31*c*. The arm 31*k* is located between the bearing receiving portion 41 and the bearing portion 30 of the frame 40 in the direction of the axis of rotation of the conveyance roller 20 so as to be exposed toward the space between the bearing receiving portion 41 and the bearing portion 30. The space between the bearing receiving portion 41 and the bearing portion 30 is a conveyance path that enables the sheet S conveyed by the conveyance roller 20 to pass therethrough.

An operator who replaces the conveyance roller 20 can access the conveyance path (the work space) from the outside of the image forming apparatus 101 (the outside of the sheet conveyance device 100). Since the arm 31*k* is exposed to the conveyance path, the operator who replaces the conveyance roller 20 can easily access the conveyance path and operate the arm 31*k*. Thus, the operator can easily move the open bearing 31. Note that the image forming apparatus 101 or the sheet conveyance device 100 may have an opening and closing member that covers the opening for the operator to access the conveying path.

The open bearing 31 restricts the movement thereof relative to the frame 40 in an F direction, which is the rotation axis direction with respect to the frame 40, by sandwiching the frame 40 between three frame locking ribs 31*g*, 31*h*, and 31*i* and a frame locking surface 31*e*. The open bearing 31 has a notch passage portion having a width (width L6) less than a width L7 of the frame notch portion 41*b* in a direction perpendicular to the movement direction from the third position to the second position. As a result, the open bearing 31 and the shaft member 20*b* can be moved to the second position along the frame notch portion 41*b* without interfering with each other.

Subsequently, the regulation of the conveyance roller 20 in the rotation axis direction is described below with reference to FIG. 8 and FIGS. 9A and 9B. In a mode illustrated in FIG. 8, the width L1 of the open portion 31*b* illustrated in FIG. 5A is greater than or equal to a shaft diameter L2 of the shaft member 20*b* illustrated in FIG. 8. For this reason, the open bearing 31 can be moved from the first position to the second position so that the conveyance roller 20 passes through the open portion 31*b*.

In addition, the shaft member 20*b* has a first regulated portion 20*c* having an outer diameter of L3 and a second regulated portion 20*d* having an outer diameter of L4. Then, in terms of the shaft diameter L2 of the shaft member 20*b*, the relationship L3>L2 and L4>L2 is satisfied. Furthermore, the first regulated portion 20*c* is located between a bearing portion engaging portion 20*f*, which is second end portion, and the open bearing 31 in the direction of the axis of rotation. For this reason, when the open bearing 31 is located at the first position and the conveyance roller 20 is supported by the open bearing 31, the two regulated portions 20*c* and 20*d* can be brought into contact with the regulation portion 31*j* of the open bearing 31. Still furthermore, in the contacted state, the movement of the conveyance roller 20 in the F direction, which is the rotation axis direction of the conveyance roller 20, is restricted. In addition, when the open bearing 31 moves from the first position to the second position, the two regulated portions 20*c* and 20*d* are separated from the regulation portion 31*j*, and the conveyance roller 20 can move in the direction of the axis of rotation.

According to the present embodiment, the relationship L1 L2 is satisfied between the width L1 of the open portion 31*b* and the shaft diameter L2 of the shaft member 20*b*. However, as illustrated in FIG. 5C, the open portion 31*b* may have a protrusion 31*f* where the width is L1*a* that satisfies a relationship L2>L1*a*, and the conveyance roller 20 may be attached by warping the open bearing 31. According to the configuration, the open bearing 31 is less likely to fall off when the conveyance roller 20 is assembled to the frame 40.

According to the present embodiment, the open bearing 31 is sandwiched between the first regulated portion 20*c* and the second regulated portion 20*d* of the conveyance roller 20 to regulate the movement of the open bearing 31 in the F direction, which is the rotation axis direction. Since the two regulated portions 20*c* and 20*d* are located close to each other with the open bearing 31 therebetween, the positional accuracy of the conveyance roller 20 in the rotation axis direction can be increased.

Figure 9A:
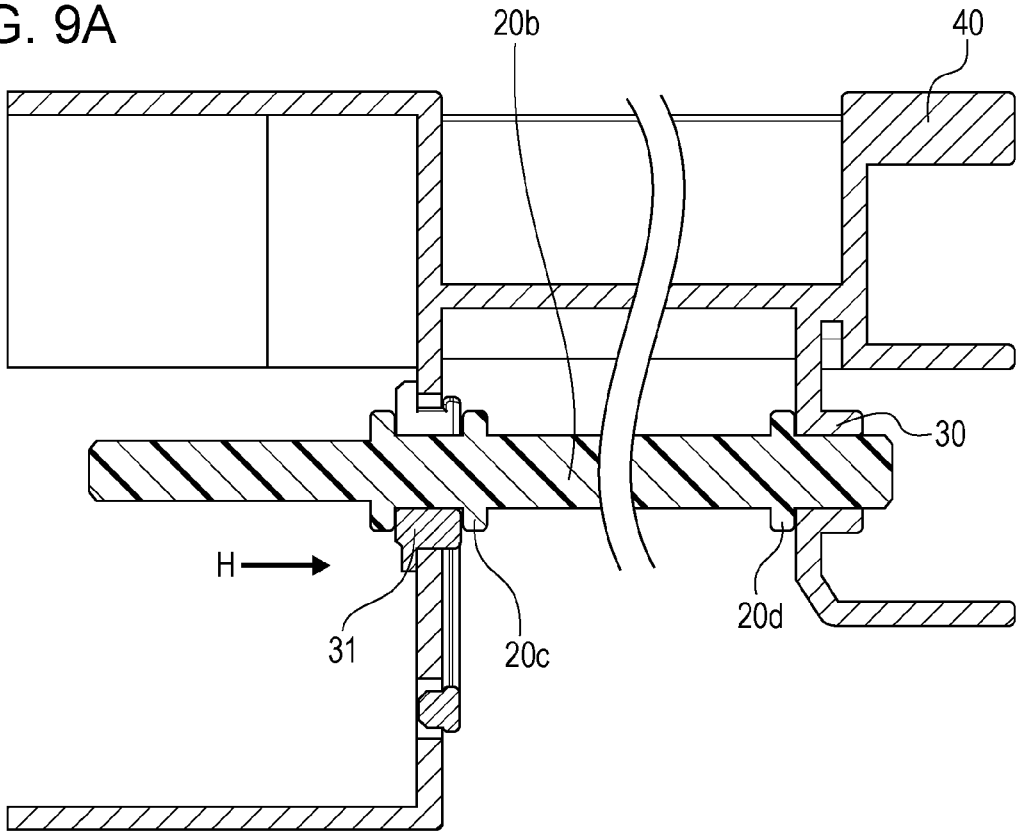
FIGS. 9A and 9B are cross-sectional views illustrating a method for regulating the movement of the conveyance roller when a second regulated portion according to the first embodiment is located on a side adjacent to the bearing portion.

Alternatively, as illustrated in FIG. 9A, the second regulated portion 20*d* may be brought into contact with the bearing portion 30 provided in the frame 40 to restrict the movement of the conveyance roller 20 in the H direction. Note that the H direction is parallel to the width direction of the sheet S and is the direction from the open bearing 31 toward the center of the sheet S. The H direction is parallel to the direction of the axis of rotation of the conveyance roller 20.

Figure 9B:
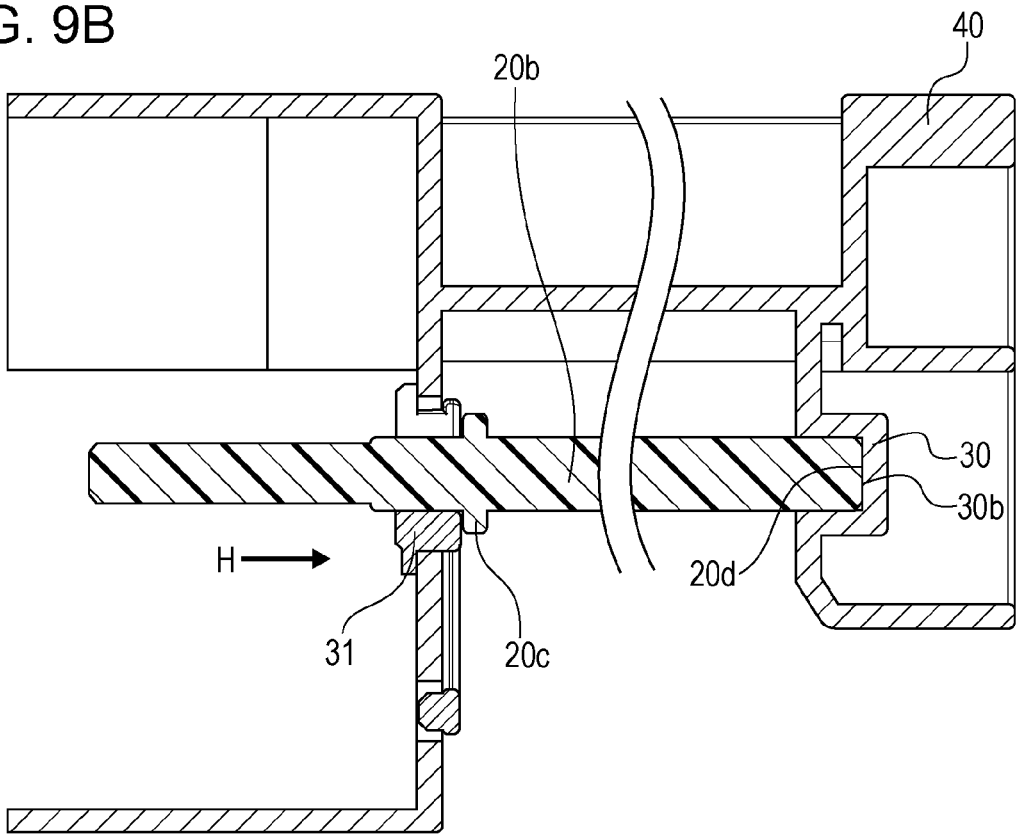

Alternatively, as illustrated in FIG. 9B, the end portion of the shaft member of the conveyance roller 20 adjacent to the bearing portion 30 may be brought into contact with a different member to regulate the movement of the conveyance roller 20 in the H direction. In this case, as an example, a contact surface 30*b* provided on the bearing portion 30 of the frame 40 is used as the different member with which the end portion of the conveyance roller 20 is brought into striking contact. The contact of the conveyance roller 20 with the bearing portion 30 or the different member facilitates the recognition of the position of the conveyance roller 20 in the rotation axis direction when the conveyance roller 20 is attached to the frame 40. Thus, the work efficiency in replacement of the conveyance roller can be increased.

Furthermore, a distance L8 between the two ribs 31*g* and 31*h* among the frame locking ribs and the remaining one rib 31*i* is less than a distance L9 between an outer diameter portion of the second regulated portion 20*d* (or the first regulated portion 20*c*) and an end of the frame notch portion 41*b*. For this reason, when the open bearing 31 is located at the second position, the conveyance roller 20 is enabled to move in the F direction, which is the rotation axis direction of the open bearing 31. In addition, a configuration can be employed in which the open bearing 31 is removed from the frame 40 by moving the open bearing 31 located at the second position in the H direction.

Figure 10A:
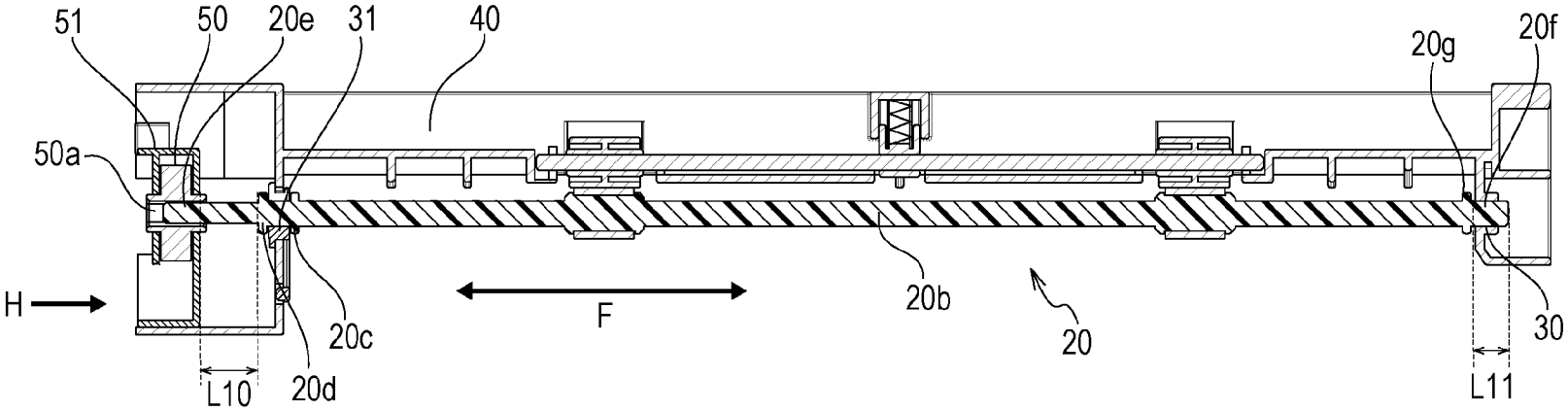
FIGS. 10A to 10C illustrate a drive transmission method between a drive transmission member and the conveyance roller according to the first embodiment.
Figure 10C:
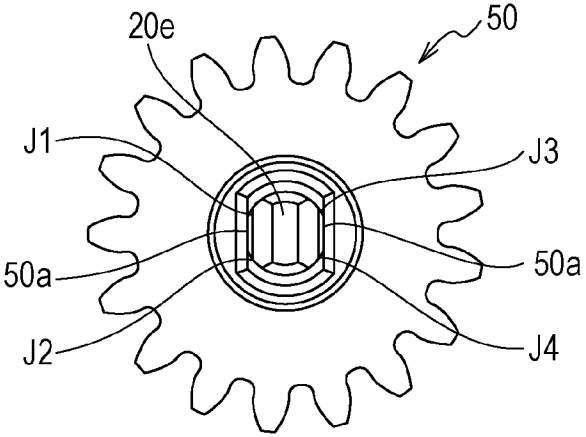
Figure 10B:
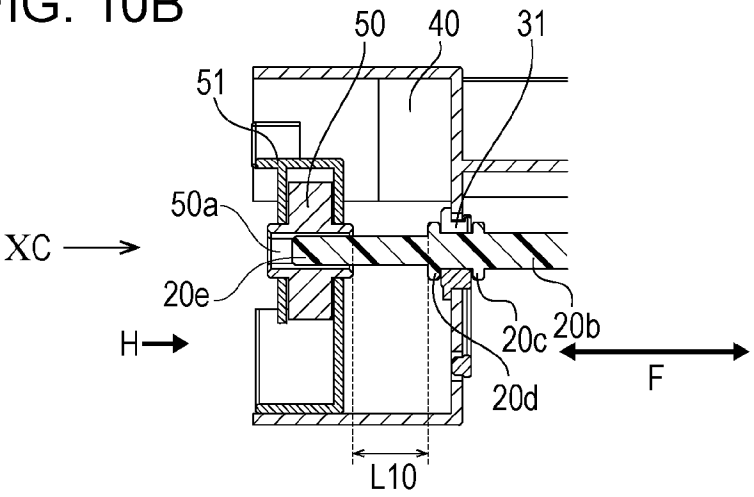

FIGS. 10A to 10C illustrate a method for transmitting a drive force from a drive transmission member 50, which is a gear, to the conveyance roller 20. FIG. 10A is a cross-sectional view taken along a line XA-XA illustrated in FIG. 3. FIG. 10B is an enlarged view of a region from the open bearing 31 to the drive transmission member 50 illustrated in the cross-sectional view of FIG. 10A.

The sheet conveyance device 100 includes a drive transmission member 50 for transmitting a drive force from a drive source (not illustrated). The conveyance roller 20 has a driven transmission portion 20*e* for receiving the driving force of the drive source from the drive transmission member 50. Furthermore, the drive transmission member 50 is supported by a drive transmission member holder 51 provided in the frame 40, and the drive transmission member holder 51 regulates the movement of the drive transmission member 50 in the F direction, which is the rotation axis direction.

FIG. 10C is a view of the drive transmission member 50 and the driven transmission portion 20*e* as viewed in the H direction.

The drive transmission member 50 includes a drive transmission portion 50*a* which is an I-shaped hole for transmitting the driving force to the driven transmission portion 20*e* which is an I-shaped shaft, and the drive transmission portion 50*a* is a through-hole extending in the F direction, which is the rotation axis direction.

As illustrated in FIG. 10C, a gap is formed between the driven transmission portion 20*e* and the drive transmission portion 50*a*. When the drive transmission member 50 receives a drive force from a drive source (not illustrated), the wall surface of the drive transmission portion 50*a* collides with corners J1 and J4 or J2 and J3 of the driven transmission portion 20*e*, and the drive force is transmitted to the conveyance roller 20. Furthermore, by providing the gap between the driven transmission portion 20*e* and the drive transmission portion 50*a*, the conveyance roller 20 can be easily attached to the drive transmission member 50.

Removal of Conveyance Roller

A method for removing the conveyance roller 20 from the frame 40 is described below with reference to FIGS. 11A to 11C.

Figure 11A:
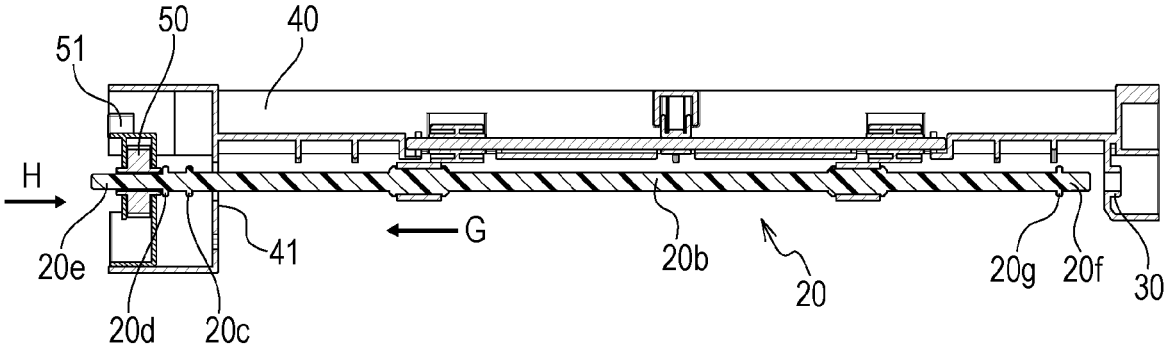
FIGS. 11A to 11C illustrate a method for removing the conveyance roller from the frame according to the first embodiment.
Figure 11B:
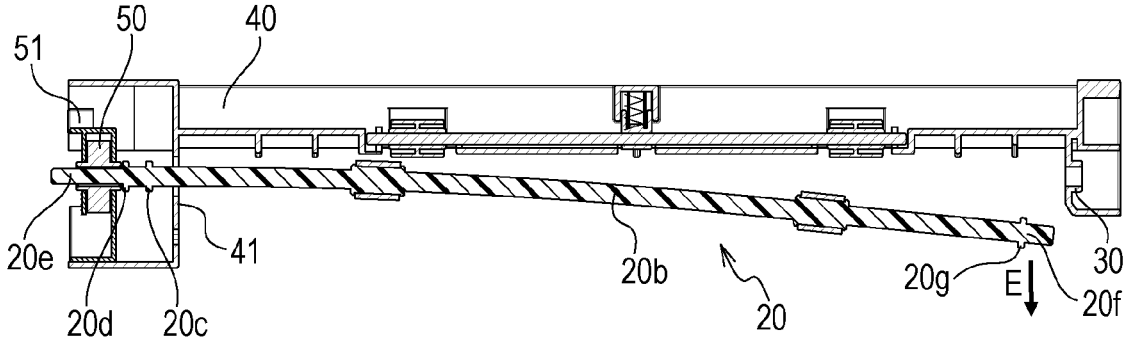
Figure 11C:
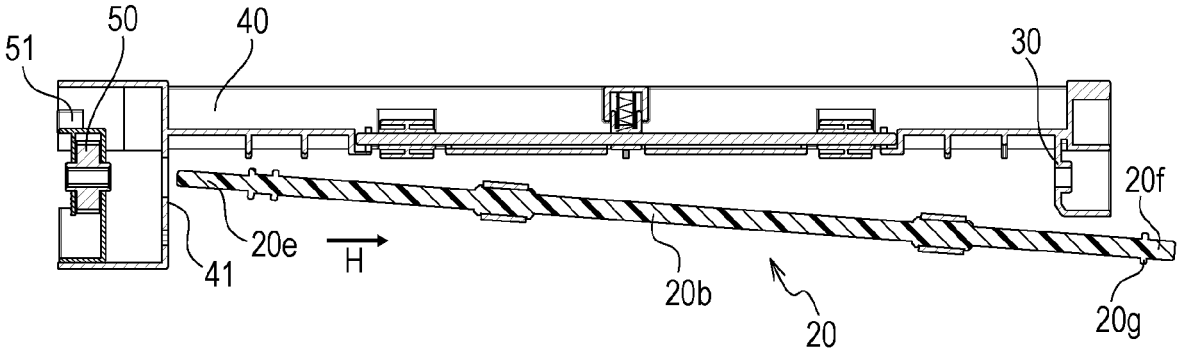

FIGS. 11A to 11C illustrate a method for removing the conveyance roller 20 from the frame 40 and are cross-sectional views taken along a line XI-XI illustrated in FIG. 3.

FIG. 11A illustrates a mode in which the open bearing 31 in the mode illustrated in FIG. 10A is moved to the second position and, thereafter, the conveyance roller 20 is moved in the direction from the bearing portion 30 to the bearing receiving portion 41 (in the rotation axis direction). FIG. 11B illustrates the conveyance roller 20 after the conveyance roller 20 illustrated in FIG. 11A is warped by a force applied to the right end of the conveyance roller 20 in the E direction. FIG. 11C illustrates the conveyance roller 20 after the conveyance roller 20 illustrated in FIG. 11B is moved to the right.

When the open bearing 31 is located at the second position, the bearing portion engaging portion 20*f*, which is the second end portion of the conveyance roller 20, can be removed from the bearing portion 30, which is a second end support portion. By moving the conveyance roller 20 to the left as illustrated in FIG. 11A when the open bearing 31 is located at the second position, the bearing portion engaging portion 20*f* is removed from the bearing portion 30. As a result, the conveyance roller 20 can be removed from the frame 40. In terms of the outer diameter L3 of the first regulated portion 20*c* and the outer diameter L4 of the second regulated portion 20*d* illustrated in FIG. 8, the outer diameter L5 of the bearing support portion 41*a* illustrated in FIG. 6 satisfies the relationship L3<L5 and L4<L5. As a result, the conveyance roller 20 can move in a G direction, which is the direction from the bearing portion 30 to the bearing receiving portion 41 (the direction from the second end portion toward the first end portion of the conveyance roller 20) in the rotation axis direction without being brought into contact with the frame 40.

In addition, when the conveyance roller 20 is moved in the G direction, the driven transmission portion 20*e* can move relative to the drive transmission member 50 in the G direction within the drive transmission portion 50*a*, which is a through-hole. Thus, only the conveyance roller 20 can be moved in the G direction with the drive transmission member 50 being supported by the drive transmission member holder 51. At this time, a distance L10 between the drive transmission member 50 and the second regulated portion 20*d* illustrated in FIG. 10A is greater than a travel distance L11 until engagement between the bearing portion engaging portion 20*f* and the bearing portion 30 is disengaged. As a result, when the conveyance roller 20 is removed, the conveyance roller 20 can be moved until the engagement between the bearing portion engaging portion 20*f* and the bearing portion 30 is disengaged.

As illustrated in FIG. 11B, the conveyance roller 20 illustrated in FIG. 11A is tilted in the E direction, which is the urging direction of the urging force received from the driven roller 21. Subsequently, as illustrated in FIG. 11C, the conveyance roller 20 is moved until the end portion of the driven transmission portion 20*e* reaches the right region in FIG. 11C beyond the bearing receiving portion 41, so that only the conveyance roller 20 can be removed from the frame 40. During this removal process, the driven roller 21 is being attached to the frame 40, and the conveyance roller 20 is removed in a direction away from the driven roller 21. Since the conveyance roller 20 can be removed from the frame 40 without removing the driven roller 21 from the frame 40, the efficiency of the replacement operation of the conveyance roller 20 can be increased, and the maintainability can be improved.

According to the present embodiment, when the conveyance roller 20 is removed from the frame 40, the conveyance roller 20 can be warped and removed. It is desirable that the material of the shaft member 20*b* of the conveyance roller 20 contain a resin. Note that according to the present embodiment, the material of the shaft member 20*b* is a resin. The material of the shaft member 20*b* may contain a resin and a metal.

In addition, when the procedure for the removal operation illustrated in FIGS. 11A to 11C is performed in the reverse order, the conveyance roller 20 can be attached to the frame 40.

Furthermore, the shaft member 20*b* has a third regulated portion 20*g* adjacent to the bearing portion 30. When the conveyance roller 20 is supported by the frame 40 using the open bearing 31 and the bearing portion 30, a gap is formed between the third regulated portion 20*g* and the bearing portion 30. The size of the gap is such that it is greater than or equal to zero in the F direction, which is the rotation axis direction, even after taking into consideration of the dimensional tolerance and thermal expansion of the third regulated portion 20*g* and peripheral parts.

When the conveyance roller 20 located at the position illustrated in FIG. 11A is moved in the H direction, the third regulated portion 20*g* is brought into contact with the bearing portion 30, so that the movement of the conveyance roller 20 in the H direction is restricted. At this time, since the bearing receiving portion 41 of the frame 40 and the two regulated portions 20*c* and 20*d* are located close to each other, the open bearing 31 can be easily attached to the conveyance roller 20.

According to the configuration of the present disclosure, when the conveyance roller 20 is replaced, the conveyance roller 20 can be removed by moving the open bearing 31 to the second position, which increases the efficiency of replacement of the conveyance roller 20. Furthermore, since only the conveyance roller 20 can be replaced without replacing the open bearing 31, the number of parts to be replaced can be minimized, which leads to a reduction in replacement cost.

Second Embodiment

The second embodiment of the present disclosure is described below with reference to FIGS. 12 to 15. According to the present embodiment, description of parts common to those according to the first embodiment is not repeated. Unlike the first embodiment, the drive transmission member 50 is supported by the conveyance roller 20 instead of the drive transmission member holder 51, and the drive transmission member 50 is attached/detached together with the conveyance roller 20 when the conveyance roller 20 is attached/detached.

Figure 12:
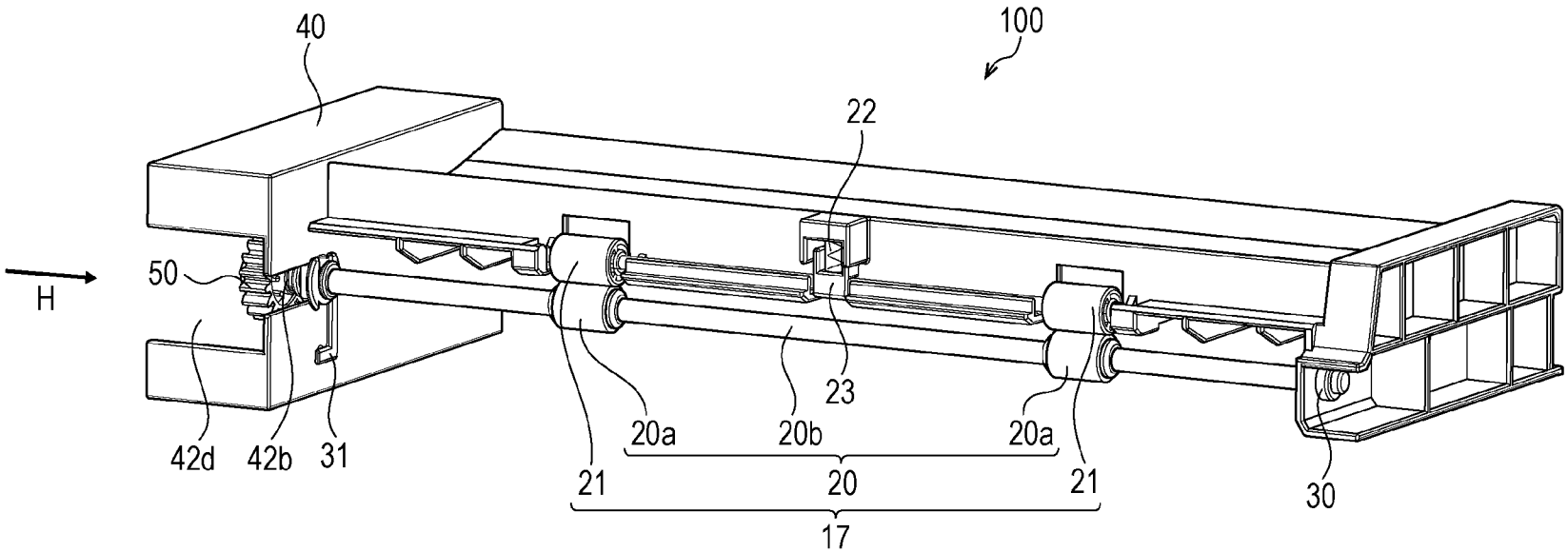
FIG. 12 is a perspective view illustrating the location of the sheet conveyance device according to a second embodiment.
Figure 13:
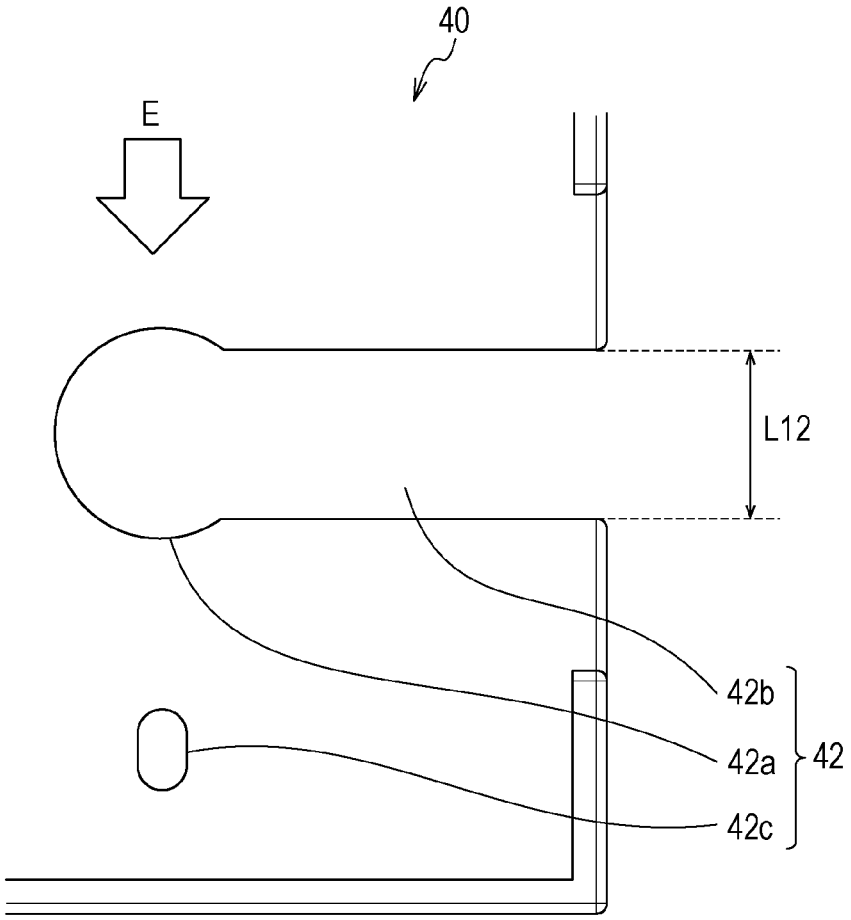
FIG. 13 illustrates the configuration of a bearing receiving portion of a frame according to the second embodiment.

FIG. 12 is a perspective view of a sheet conveyance device 100 according to the second embodiment. FIG. 13 is a view of a bearing receiving portion 42 of the frame 40 as viewed from the open bearing 31 in the H direction, which is the direction from the open bearing 31 to the center of a sheet in the width direction.

FIG. 13 is a view of the bearing receiving portion 42 of the frame 40 that supports the open bearing 31 as viewed in the H direction, which is the direction from the open bearing 31 to the bearing portion 30 in FIG. 8, according to the second embodiment. The bearing receiving portion 42 illustrated in FIG. 13 has a bearing support portion (a first portion) 42*a* that supports the open bearing 31 so that the open bearing 31 is located at the first position. In addition, the bearing receiving portion 42 has a frame notch portion 42*b* (a second portion, a frame through-hole, a guide portion) that leads the open bearing 31 from the first position to the second position and a rotation stopper portion 42*c* that engages with the rotation stopped portion 31*c* of the open bearing 31.

A width L12 of the frame notch portion 42*b*, which is a hole, is greater than the shaft diameter L2 of the shaft member 20*b*. In addition, when the open bearing 31 is moved from the second position in the direction toward the frame notch portion 42*b*, the open bearing 31 can be moved to a removal position at which the open bearing 31 is removed from the frame 40.

Figure 14A:
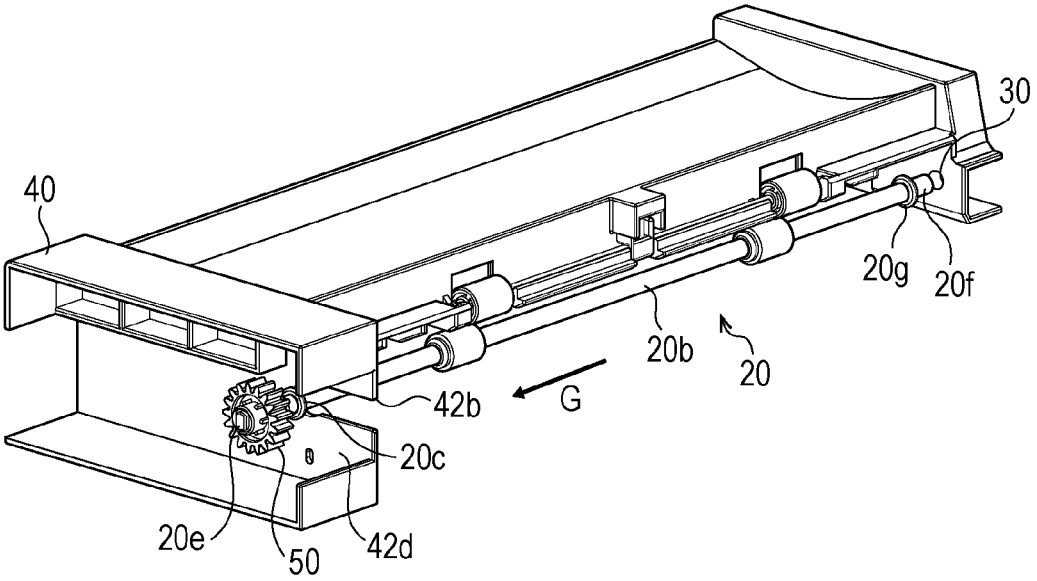
FIGS. 14A and 14B illustrate a method for removing a conveyance roller from the frame according to the second embodiment.
Figure 14B:
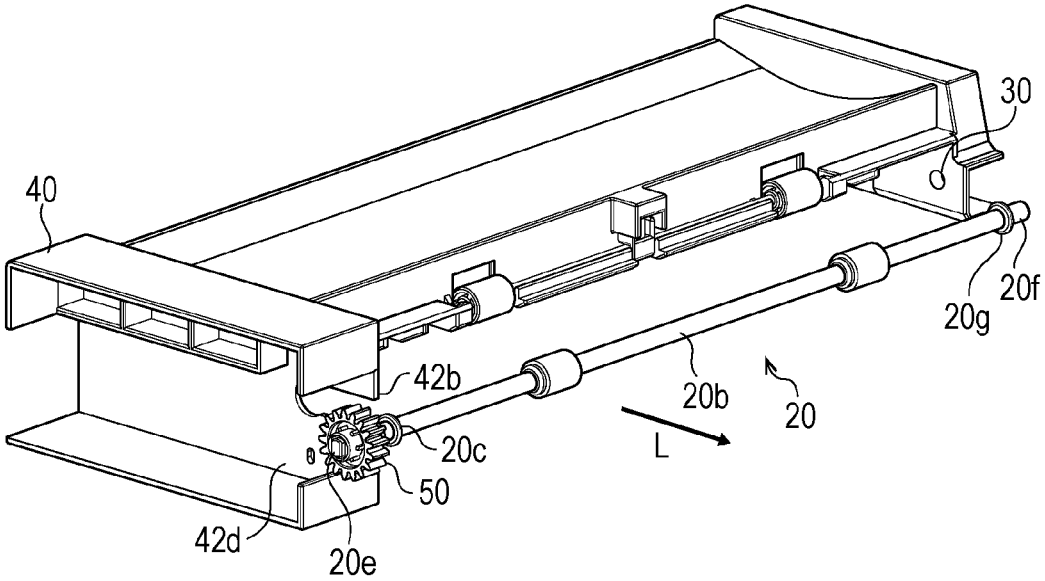

FIGS. 14A and 14B are perspective views of the sheet conveyance device 100 and illustrate a method for removing the conveyance roller 20. The drive transmission member 50 is supported by the driven transmission portion 20*e* of the conveyance roller 20. FIG. 14A illustrates the bearing portion 30 and the bearing portion engaging portion 20*f* that are disengaged from each other by removing the open bearing 31 from the frame 40 and moving the conveyance roller 20 in the G direction, which is the direction from the center of a sheet width to the open bearing 31.

FIG. 14B is a diagram in which the conveyance roller 20 is removed from the frame 40. As illustrated in FIG. 14B, the conveyance roller 20 illustrated in FIG. 14A is moved in an L direction along the frame notch portion 42*b* of the frame 40, so that the drive transmission member 50 and the conveyance roller 20 can be removed from the frame 40.

Figure 15:
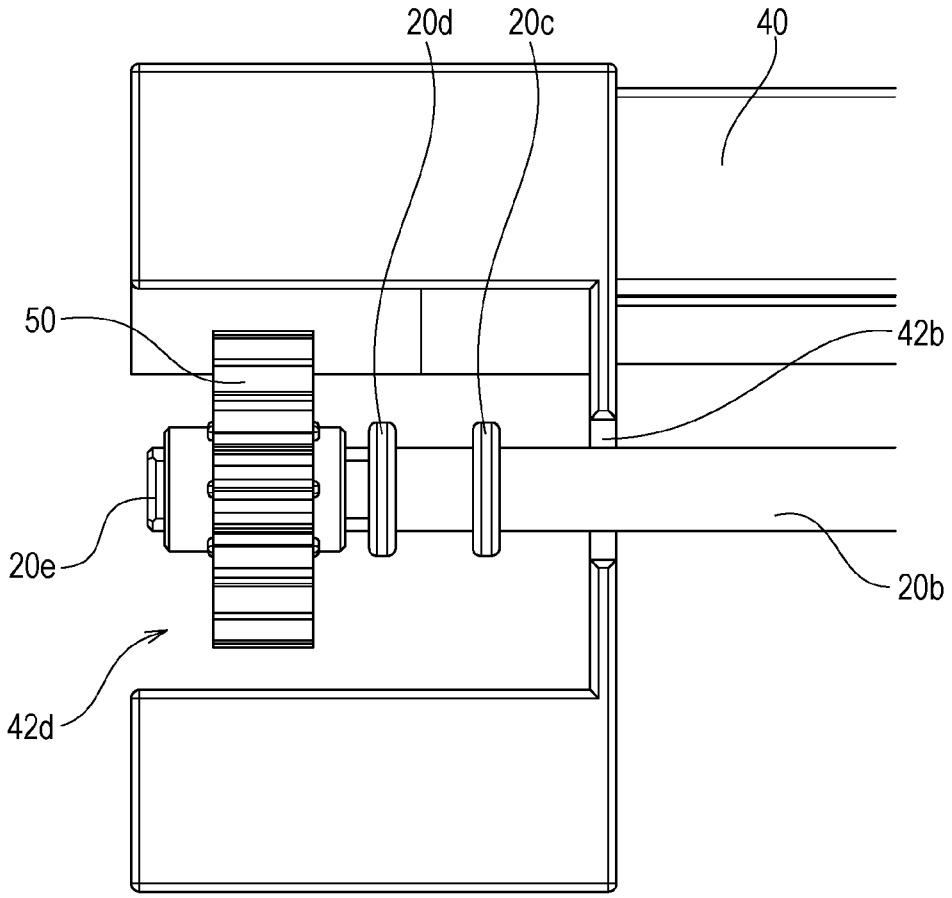
FIG. 15 illustrates the shape of a drive transmission member passage hole according to the second embodiment.

As illustrated in FIG. 15, the frame 40 has a drive transmission member passage hole 42*d* having a hole width greater than the outer diameter of the drive transmission member 50, in addition to the frame notch portion 42*b* that enables the conveyance roller 20 to pass therethrough. Due to the drive transmission member passage hole 42*d*, the drive transmission member 50 is not brought into contact with the frame 40 when the conveyance roller 20 is removed.

The configuration according to the second embodiment is such that the conveyance roller 20 can be attached/detached even if the conveyance roller 20 includes a metal shaft or a highly rigid shaft that is difficult to be inclined when the conveyance roller 20 is attached/detached.

According to the present disclosure, a sheet conveyance device that enables a conveyance roller to be replaced without replacing a bearing member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-060819 filed Mar. 31, 2021, which is hereby incorporated by reference herein in its entirety.

What is claimed is:

1. A sheet conveyance device comprising:

a conveyance roller configured to rotate about an axis of rotation to convey a sheet, wherein the conveyance roller has a first end portion and a second end portion in a direction of the axis of rotation;

an open bearing configured to support the first end portion so that the conveyance roller is rotatable;

a frame configured to support the open bearing; and a second end support portion configured to support the second end portion so that the conveyance roller is rotatable, wherein the open bearing includes a conveyance roller support portion configured to support the conveyance roller and an open portion configured to allow the conveyance roller to be removed through the open portion from the conveyance roller support portion in a direction perpendicular to the axis of rotation, wherein, in a state where the open bearing is mounted in the frame, the open bearing is movable between a first position at which the conveyance roller is restricted from moving in the direction of the axis of rotation and a second position at which the conveyance roller is removed from the open bearing and is enabled to move in the direction of the axis of rotation, wherein, when the open bearing is moved from the first position to the second position, the conveyance roller passes through the open portion, wherein, in a state where the open bearing is located at the second position, the second end portion is removable from the second end support portion by moving the conveyance roller from the second end portion toward the first end portion, and wherein the frame has a bearing support portion configured to support the open bearing so that the open bearing is located at the first position and has a guide portion configured to lead the open bearing from the first position to the second position.

2. The sheet conveyance device according to claim 1, wherein the open bearing includes a rotation stopped portion, wherein the frame has a rotation stopper portion configured to engage with the rotation stopped portion, wherein the open bearing located at the first position is restricted from rotating when the rotation stopped portion is engaged with the rotation stopper portion, wherein the open bearing located at the first position is configured to rotate from the first position to a third position when the rotation stopped portion is disengaged from the rotation stopper portion, and wherein the open bearing is movable from the third position to the second position.

3. The sheet conveyance device according to claim 1, wherein the open bearing includes a regulation portion configured to restrict the conveyance roller from moving in the direction of the axis of rotation at the first position, wherein the conveyance roller includes a regulated portion that is restricted from moving in the direction of the axis of rotation by being brought into contact with the regulation portion, wherein the regulated portion is configured to be brought into contact with the regulation portion with the open bearing located at the first position, and wherein the regulated portion is separated from the regulation portion with the open bearing located at the second position.

4. The sheet conveyance device according to claim 3, wherein, when the open bearing is located at the first position, the regulated portion is located between the second end portion and the open bearing in the direction of the axis of rotation.

5. The sheet conveyance device according to claim 1, wherein the frame includes the second end support portion.

6. The sheet conveyance device according to claim 1, further comprising a drive transmission portion configured to transmit a drive force from a drive source, wherein the conveyance roller has a driven transmission portion configured to receive the drive force from the drive transmission portion.

7. The sheet conveyance device according to claim 1, wherein the open bearing is movable from the second position to a removal position at which the open bearing is removed from the frame, and wherein the frame has a removal portion configured to allow the open bearing to move from the second position to the removal position.

8. An image forming apparatus comprising:

the sheet conveyance device according to claim 1;

a transfer unit configured to transfer a toner image formed on a photosensitive drum to the sheet; and a fixing unit configured to fix toner transferred by the transfer unit to the sheet.

* * * * *